US008678774B2

(12) United States Patent
Park et al.

(10) Patent No.: US 8,678,774 B2
(45) Date of Patent: Mar. 25, 2014

(54) SCROLL COMPRESSOR

(75) Inventors: Jung Hoon Park, Changwon (KR); Sung Soon Jang, Changwon (KR); Jeong Hun Kim, Changwon (KR); Na Ra Han, Changwon (KR)

(73) Assignee: LG Electronics Inc., Seoul (KR)

( * ) Notice: Subject to any disclaimer, the term of this patent is extended or adjusted under 35 U.S.C. 154(b) by 409 days.

(21) Appl. No.: 13/020,123

(22) Filed: Feb. 3, 2011

(65) Prior Publication Data

US 2011/0243775 A1 Oct. 6, 2011

Related U.S. Application Data

(60) Provisional application No. 61/319,968, filed on Apr. 1, 2010.

(30) Foreign Application Priority Data

May 12, 2010 (KR) ..... 10-2010-0044658

(51) Int. Cl.
*F01C 1/02* (2006.01)

(52) U.S. Cl.
USPC ..... 417/44.1; 417/410.5; 418/55.1

(58) Field of Classification Search
USPC ..... 417/44.1, 410.5; 418/55.1
See application file for complete search history.

(56) References Cited

U.S. PATENT DOCUMENTS

| | | | | |
|---|---|---|---|---|
| 5,460,494 | A | 10/1995 | Lee | |
| 5,961,297 | A * | 10/1999 | Haga et al. | 417/310 |
| 7,896,629 | B2 * | 3/2011 | Ignatiev et al. | 418/55.1 |

FOREIGN PATENT DOCUMENTS

| | | |
|---|---|---|
| CN | 2214545 | 12/1995 |
| CN | 1566692 | 1/2005 |
| WO | WO 93/13316 | 7/1993 |

OTHER PUBLICATIONS

Chinese Office Action dated May 27, 2013. (translation of claims).

* cited by examiner

*Primary Examiner* — Charles Freay
*Assistant Examiner* — Patrick Hamo
(74) *Attorney, Agent, or Firm* — KED & Associates LLP

(57) ABSTRACT

A scroll compressor is provided. A value obtained by multiplying a wrap height (H) by a driving speed (V) may be controlled to be within a range of approximately 500~1000 mmHz at a low speed driving (less than approximately 35 Hz). The wrap height of the scroll compressor, and the driving speed may be set to be optimum, thereby preventing the scroll compressor from being operated at a speed excessively lower or higher than a predetermined driving speed. This may allow the scroll compressor to be operated at an optimum low speed corresponding to the wrap height, and thus, the compressor and a refrigerating cycle apparatus having the same may have enhanced performances.

15 Claims, 5 Drawing Sheets

| WRAP HEIGHT(mm) <H> | DRIVING SPEED(Hz) <V> | <H>×<V> | EER |
|---|---|---|---|
| 20 | 20 | 400 | 17.5 |
| 23 | 22 | 506 | 18.5 |
| 25 | 22 | 550 | 18.8 |
| 28 | 30 | 840 | 19.5 |
| 30 | 30 | 900 | 19.6 |
| 40 | 30 | 1200 | 17.9 |

SCROLL COMPRESSOR

CROSS-REFERENCE TO RELATED APPLICATION(S)

Pursuant to 35 U.S.C. §119(a), this application claims priority to U.S. Provisional Application No. 61/319,968, filed on Apr. 1, 2010, and Korean Application No. 10-2010-0044658, filed on May 12, 2010, the contents of both of which are hereby incorporated by reference in their entirety.

BACKGROUND

1. Field

A scroll compressor is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
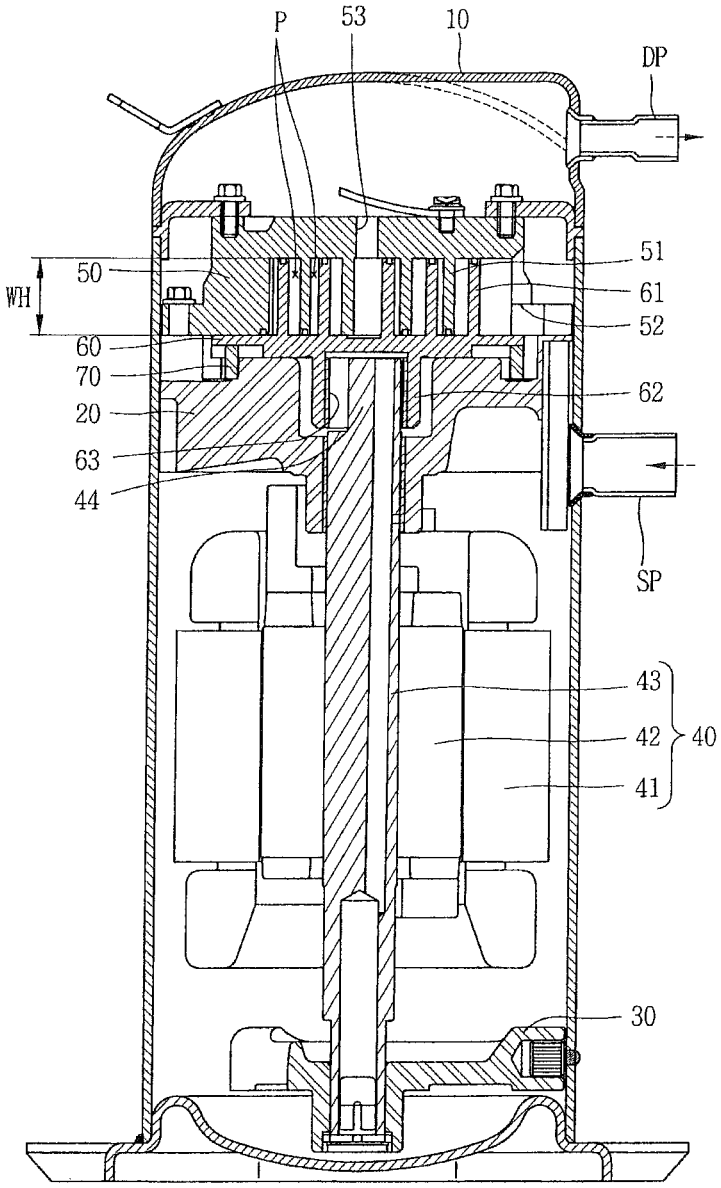
FIG. 1 is a longitudinal sectional view of a variable radius type scroll compressor according to an embodiment.

A detailed description of embodiments is provided hereinbelow, with reference to the accompanying drawings. Where possible, like reference numerals have been used to indicate like elements, and repetitive description has been omitted.

A scroll compressor is a compressor that compresses refrigerant gas by changing a volume of a compression chamber formed by a pair of scrolls that face each other. A scroll compressor has a higher efficiency and lower noise than, for example, a reciprocating compressor or a rotary compressor. Further, due to its small size and light weight, the scroll compressors are being widely applied to air conditioners.

Scroll compressor may be generally categorized as a low pressure type or a high pressure type, according to a pressure of refrigerant filled at an inner space of a hermatic container. In the low pressure type scroll compressor, because a suction pipe communicates with the inner space of the hermatic container, refrigerant is indirectly sucked into a compression chamber through the inner space of the hermatic container. On the other hand, in the high pressure type scroll compressor, because a suction pipe directly communicates with a suction side of a compression unit or device, refrigerant is directly suctioned into a compression chamber without passing through the inner space of the hermatic container.

Due to complicated scroll wraps, it is not easy to minimize frictional loss between the wraps, while maintaining high compression efficiency of the scroll compressor. In order to enhance the compression efficiency of the scroll compressor, a gap between the wraps has to be minimized to reduce leakage of refrigerant in a radial direction. However, in the case of minimizing the gap between the wraps, frictional loss may occur lowering compression efficiency. To solve this problem, a variable radius type scroll compressor capable of allowing an orbiting scroll to forwardly move according to a pressure change inside a compression chamber has been proposed.

In the variable radius type scroll compressor, a sliding bush that performs a sliding motion in a radial direction may be inserted between an orbiting scroll and a rotational shaft, so that a gap between wraps may be temporarily increased as the orbiting scroll is backwardly moved at a time of over-compression. This may prevent lowering of compression efficiency due to over compression.

The scroll compressor may further be categorized as a constant speed type or an inverter type, according to a driving method of a drive motor. The constant speed type refers to a compressor having the same driving speed regardless of changes in load, whereas the inverter type refers to a compressor having a driving speed varied according to changes in load.

The variable radius and inverter type scroll compressor has a lower performance in a low speed driving mode than in a high speed driving mode. The reason is because an oil supply amount is deficient, and leakage of refrigerant in a radial direction occurs due to a deficiency in centrifugal force as a gap between the orbiting scroll wrap and the fixed scroll wrap increases. Moreover, a gap occurs in an axial direction between the orbiting scroll wrap and a plate of the fixed scroll, or between a plate of the orbiting scroll and the plate of the fixed scroll, due to low floating of the orbiting scroll.

In the scroll compressor, once a radius of a reference circle, a reference angle, and a starting angle and an ending angle of an involute of a wrap are determined, a shape of the scroll may be designed. Further, once a capacity of the compressor is determined, a height of the wrap may be determined. In order to change the capacity (for example, stroke volume) of the compressor, the height of the wrap may be controlled rather than changing the basic shape of the scroll.

However, conventional scroll compressors may have the following problems.

First, if the wrap has a height lower than or higher than a predetermined level when the scroll compressor is operated at a low speed, performance of the scroll compressor may be reduced. That is, if the wrap of the scroll compressor has a very low height, the scroll compressor may have a stable behavior. However, in this case, a compression volume of the scroll compressor may be decreased. Accordingly, in order to implement the same cooling capacity as that of a scroll compressor having a relatively higher wrap height, a driving speed of the scroll compressor may be increased. This may lower a performance of the scroll compressor with respect to the same input. On the other hand, when the wrap of the scroll compressor has a height more than a predetermined level (for example, approximately 40 mm), the scroll compressor has a large centrifugal force even when operated at a low speed. Accordingly, an orbiting radius of the orbiting scroll may be increased, and frictional loss increased, thereby lowering performance of the scroll compressor.

Once the scroll compressor having been completely fabricated is applied to a refrigerating cycle, such as an air conditioner, a height of the wrap of the scroll compressor can not be varied. Accordingly, in order to vary a capacity of the variable radius and inverter type scroll compressor, a driving speed of a drive motor has to be changed. However, if the height of the wrap is set to a height higher than or lower than a predetermined level in a state in which the drive motor is driven at a low speed (for example, a speed less than approximately 35 Hz), the scroll compressor may have a lowered performance. Accordingly, a driving speed of the drive motor according to a wrap height of the scroll compressor has to be maintained within a proper range.

Hereinafter, a scroll compressor according to embodiments will be explained in more detail with reference to the attached drawings.

Figure 2:
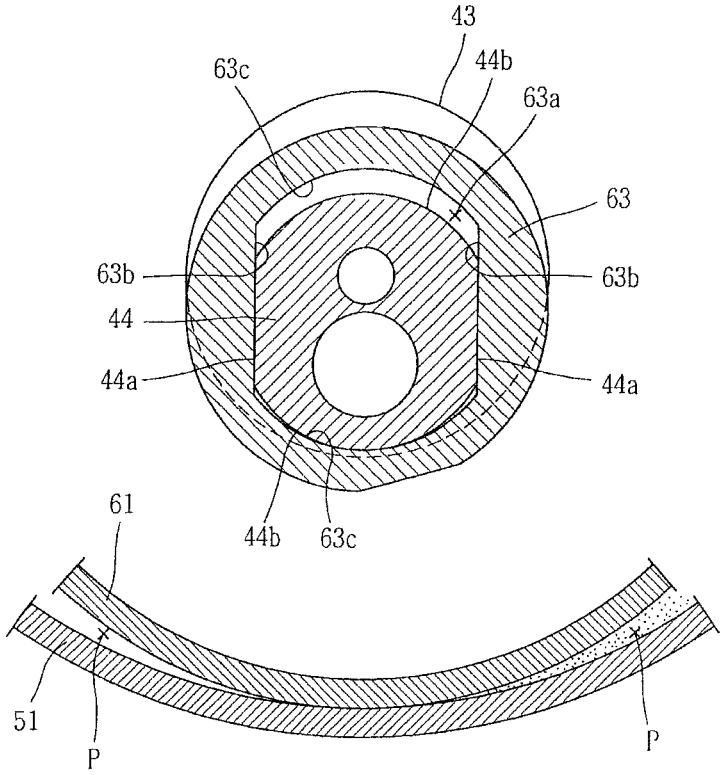
FIGS. 2 and 3 are schematic views showing a sealing state and a leakage state in a radial direction of the scroll compressor of FIG. 1.
Figure 3:
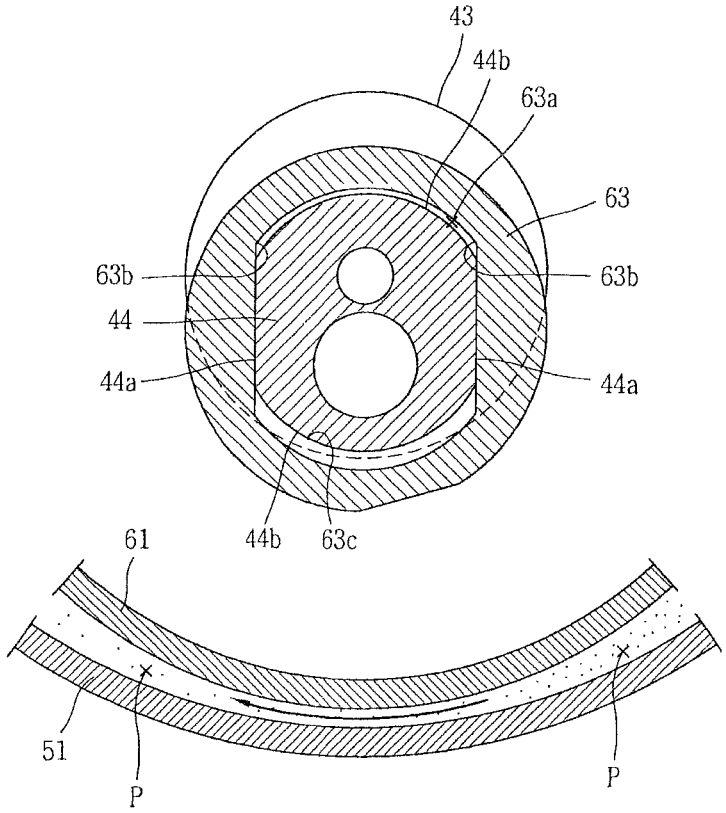

FIG. 1 is a longitudinal sectional view of a variable radius type scroll compressor according to an embodiment. FIGS. 2 and 3 are schematic views showing a sealing state and a leakage state in a radial direction of the scroll compressor of FIG. 1.

As shown in FIGS. 1 to 3, the scroll compressor according to embodiments may include a hermatic container 10, a main frame 20 and a sub frame 30 installed in the hermatic container 10, a drive motor 40 that serves as a power transmission device and which may be installed between the main frame 20 and a sub-frame 30, and a compression device, including of a fixed scroll 50 and an orbiting scroll 60, configured to compress refrigerant by being coupled to the drive motor 40 above the main frame 20.

The drive motor 40 may include a stator 41, on which a coil may be wound, a rotor 42 rotatably inserted into the stator 41, and a rotational shaft 43 forcibly inserted into a center of the rotor 42 that transmits a rotational force to the compression device. The rotational shaft 43 may be provided with a driving pin 44 that eccentrically protrudes from an upper end thereof.

The driving pin 44 may have a rectangular-circle shape, as shown in FIG. 2. That is, side surfaces 44*a* of the driving pin 44 may be formed as planar surfaces, so as to slidably contact sliding surfaces 63*b* of a sliding bush 63 which will be explained in detail hereinafter. Front and rear surfaces 44*b* of the driving pin 44, that is, both surfaces of the driving pin 44 where the sliding bush 63 slides may be curved. It is noted that the front and rear surfaces 44*b* of the driving pin 44 may be planar; however, when edges of the two side surfaces 44*a* are angular, abrasion may occur at a sliding recess 63*a* of the sliding bush 63. Accordingly, the edges may be curved where the front and rear surfaces of the driving pin 44 are curved or planar.

The compression device may include the fixed scroll 50 fixed to an upper surface of the main frame 20, the orbiting scroll 60 disposed on an upper surface of the main frame 20 so as to be engaged with the fixed scroll 50, and an Oldham ring 70 disposed between the orbiting scroll 60 and the main frame 20 and configured to prevent rotation of the orbiting scroll 60. The fixed scroll 50 may be provided with a fixed wrap 51 wound in a spiral shape and forming a compression chamber (P) together with an orbiting wrap 61 discussed hereinbelow. The orbiting scroll 60 may be provided with an orbiting wrap 61 wound in a spiral shape and forming a compression chamber (P) by being engaged with the fixed wrap 51. A boss portion 62 configured to receive a rotational force by being coupled to the rotational shaft 43 may protrude from a bottom surface of the orbiting scroll 60, that is, a side surface opposite to the orbiting wrap 61.

The sliding bush 63, which may be slidably coupled to the driving pin 44 of the rotational shaft 43 in a radial direction, may be slidably coupled to the boss portion 62 of the orbiting scroll 60 in a rotational direction. An outer diameter of the sliding bush 63 may be nearly the same diameter as an inner diameter of the boss portion 62 of the orbiting scroll 60. The sliding recess 63*a* may be positioned at a central portion of the sliding bush 63 in a rectangular shape, such that the driving pin 44 of the rotational shaft 43 is slidable in a radial direction.

The sliding recess 63*a* may have nearly the same shape as the driving pin 44, and may have a length longer than that of the driving pin 44. The sliding surfaces 63*b* of the sliding recess 63*a* may be planar like the side surfaces 44*a* of the driving pin 44. Further, front and rear stopper surfaces 63*c* of the sliding recess 63*a* may be curved or planar, like the front and rear surfaces 44*b* of the driving pin 44.

Reference numeral 52 denotes an inlet, 53 denotes an outlet, SP denotes a suction pipe, and DP denotes a discharge pipe.

Hereinafter, operation of the scroll compressor according to embodiments will be explained as follows.

Once the rotational shaft 43 is rotated as power is supplied to the drive motor 40, the orbiting scroll 60, which is eccentrically coupled to the rotational shaft 43, may perform an orbiting motion along a predetermined orbit. The compression chamber (P) formed between the orbiting scroll 60 and the fixed scroll 50 may consecutively move as a center of the orbiting motion, thus having a decreased volume. Accordingly, refrigerant may be consecutively sucked, compressed, and discharged.

This operation will be explained in more detail with reference to FIG. 2. When the scroll compressor is initially driven, a gas force of the compression chamber (P) may be lower than a centrifugal force of the orbiting scroll 60. Accordingly, the orbiting scroll 60 may have a tendency to move outwardly due to the centrifugal force. As the sliding bush 63 coupled to the orbiting scroll 60 is slidably coupled to the driving pin 44 of the rotational shaft 43, the orbiting scroll 60 may perform a sliding motion in the centrifugal force direction, that is, the eccentric direction of the driving pin 44. With this process, the orbiting wrap 61 of the orbiting scroll 60 may be engaged with the fixed wrap 51 of the fixed scroll 50, thus to stably form the compression chamber (P), and consecutively move toward the center.

In the case that the drive motor 40 performs a high speed driving (for example, more than approximately 35 Hz), the centrifugal force of the orbiting scroll 60 may be increased to increase an orbiting radius of the orbiting scroll. This may allow the orbiting wrap 61 to more closely contact the fixed wrap 51, thereby minimizing leakage of refrigerant in a radial direction, and thus enhancing a performance of the scroll compressor. However, when the centrifugal force of the orbiting scroll 60 is more than a predetermined level, the orbiting wrap 61 may contact the fixed wrap 51 too closely. In this case, if an oil supply is deficient, frictional loss may be increased, lowering the performance of the scroll compressor and/or the wraps may be damaged.

When the orbiting wrap 61 contacts the fixed wrap 51 too closely as the centrifugal force of the orbiting scroll 61 is increased, the gas force of the compression chamber (P) may generate a repulsive force. Due to this repulsive force, the orbiting scroll 60 receives force in a centripetal direction. Due to this centripetal force, the orbiting scroll 60 moves, by the sliding bush 63 and the driving pin 44 of the rotational shaft 43, in a direction such that the orbiting wrap 61 may be spaced from the fixed wrap 51. This may cause leakage of refrigerant in a radial direction, thereby reducing frictional loss between the orbiting wrap 61 and the fixed wrap 51.

On the other hand, in the case that the drive motor 40 performs a low speed driving (for example, less than approximately 35 Hz), the centrifugal force of the orbiting scroll 60 may be decreased to decrease the orbiting radius of the orbiting scroll 60. This may allow the orbiting wrap 61 to be spaced from the fixed wrap 51, thereby causing leakage of refrigerant in a radial direction. Therefore, it is required that the orbiting wrap of the orbiting scroll 60 have a height maximized within a range not to cause a frictional loss with the fixed scroll 50. This may prevent leakage of refrigerant in a radial direction by maintaining a centrifugal force of the orbiting scroll 60 at a value more than a predetermined level even if the drive motor 40 performs a low speed driving.

For instance, in a case that a driving speed of the drive motor 40 (that is, a rotational speed of the orbiting scroll 60) is less than approximately 35 Hz, the orbiting scroll may have an orbiting wrap height more than approximately 20 mm (for example, approximately 20~40 mm), that is, an orbiting wrap height optimum for a value (H×V) obtained by multiplying the height (H) of the orbiting wrap by the driving speed (V) to be within a range of approximately 500~1000 mmHz. The orbiting wrap height may be symmetrical to a fixed wrap height. Accordingly, the orbiting wrap height may be represented as a wrap height.

Figure 4:
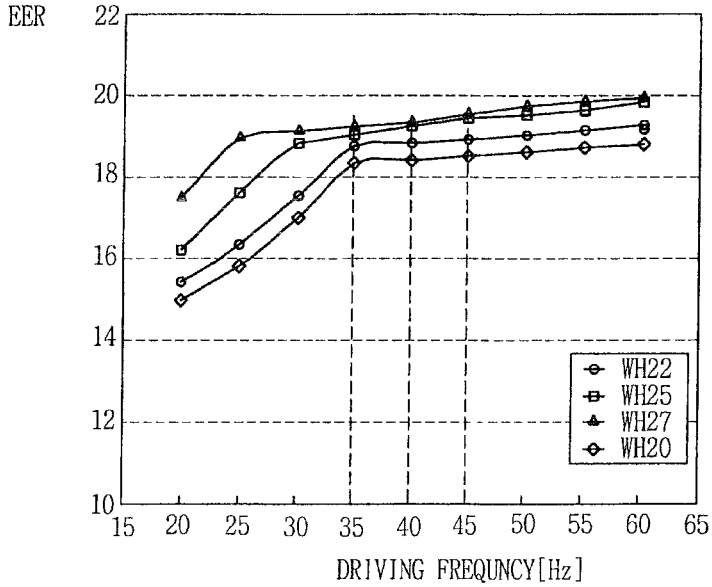
FIG. 4 is a graph showing changes in performance of the scroll compressor of FIG. 1 according to wrap height.
Figure 5:
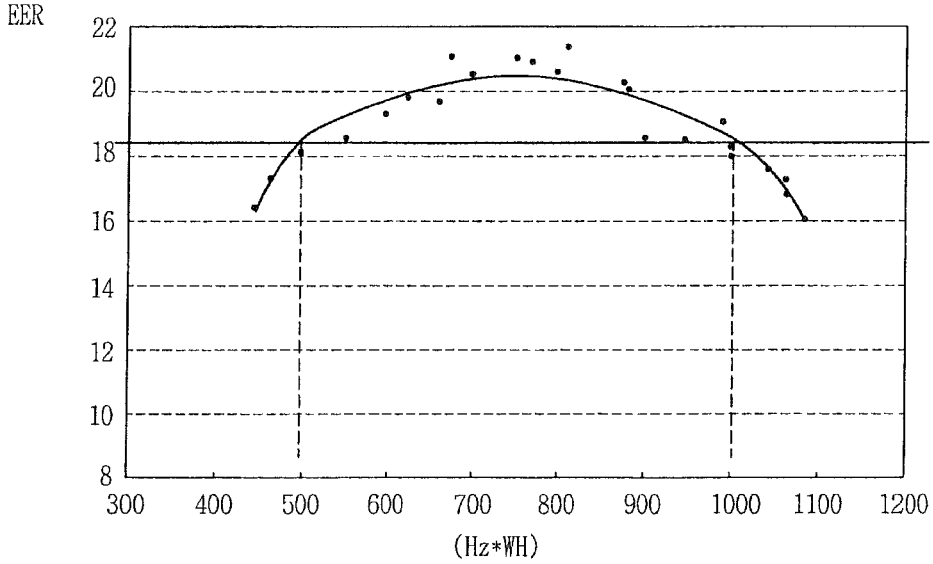
FIG. 5 is a graph showing a correlation between a wrap height set at approximately 22 mm and a driving speed.

FIG. 4 is a graph showing changes in performance of the scroll compressor according to wrap height. Referring to FIG. 4, the scroll compressor has significant performance change according to change in wrap height when driven at a low speed less than approximately 35 Hz. When the value (H×V) obtained by multiplying the wrap height (H) by the driving speed (V) is not within a predetermined range (approximately 500~1000 mmHz), the scroll compressor may have a lower performance. FIG. 5 is a graph showing a correlation between a wrap height set as approximately 22 mm and the driving speed. Referring to FIG. 5, when the value obtained by multiplying the wrap height (H) by the driving speed (V) is within a range of approximately 500~1000 mmHz, the performance of the scroll compressor has a small change in a parabolic shape. However, when the value (H×V) is less than approximately 500 mmHz or more than approximately 1000 mmHz, the performance of the scroll compressor is drastically lowered. This means that the optimum wrap height and driving speed have to be set so that the inverter type of scroll compressor can maintain a high performance at various driving speeds (approximately 20~80 Hz).

Figures 6, 7:
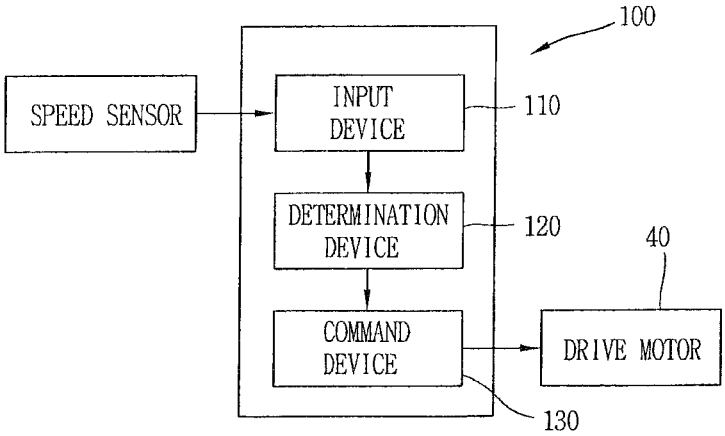
FIG. 6 is a table showing experimental results with respect to performance of the scroll compressor according to each value obtained by multiplying a wrap height by a driving speed.
FIG. 7 is a block diagram of a controller according to embodiments.

FIG. 6 is a table showing experimental results with respect to performance of the scroll compressor according to each value obtained by multiplying the wrap height by the driving speed. Referring to FIG. 6, when the scroll compressor is operated at a low speed, the scroll compressor has an increased performance as the wrap height is increased up to a predetermined height. However, when the wrap height is more than a predetermined height (approximately 40 mm in FIG. 6), the scroll compressor has a lowered performance (EER) in a low speed driving mode. Accordingly, when the scroll compressor is in a low speed driving mode (less than approximately 35 Hz), the wrap height may be set to a height less than approximately 40 mm, that is, a height within a range of approximately 20~40 mm, so that the value (H×V) can be within a range of approximately 500~1000 mmHz.

For an enhanced performance of a refrigerating cycle apparatus, when a scroll compressor having a preset wrap height is applied to the refrigerating cycle apparatus, the driving speed of the scroll compressor may be controlled so that the value (H×V) is within a range of approximately 500~1000 mmHz.

More specifically, even if the wrap height (H) is set to be within a range of approximately 20~40 mm based on a driving speed (V) less than approximately 35 Hz, in the case of the inverter type and variable radial type scroll compressor, the drive motor 40 can be operated at various driving speeds according to change in load.

For example, when a scroll compressor is designed to have a wrap height (H) of approximately 20 mm and applied to a refrigerating cycle apparatus, the scroll compressor may be controlled to have a driving speed of approximately 25~50 Hz. On the other hand, when the scroll compressor is designed to have a wrap height (H) of approximately 40 mm and is applied to a refrigerating cycle apparatus, the scroll compressor of the refrigerating cycle apparatus may be controlled to have a driving speed of approximately 13~25 Hz. However, when the scroll compressor is operated at a high speed more than approximately 35 Hz, the performance of the scroll compressor or the refrigerating cycle apparatus, to which the scroll compressor has been applied, is not greatly changed according to changes in the wrap height. Accordingly, the driving speed may not be precisely controlled at speeds greater than approximately 35 Hz.

To prevent this, the scroll compressor may further comprise a controller 100 configured to control the driving speed with respect to the wrap height. FIG. 7 is a block diagram of a controller according to embodiments. Referring to FIG. 7, the controller 100 may obtain a value calculated by using the wrap height as a constant and the driving speed as a variable, and may control the driving speed of the drive motor 40 so that the calculated value may be within a range of approximately 500~1000 mmHz.

For instance, the controller 100 may include an input device 110 configured to receive the driving speed (V) of the drive motor 40, the driving speed (V) being sensed by a speed sensor 115, a determination device 120 configured to check whether the calculated value (H×V) obtained by multiplying the driving speed (V) of the drive motor 40 input by the input device 110 by the preset wrap height (H) is within the range of approximately 500~1000 mmH, and determine whether the current driving speed is optimum, and a command device 130 configured to control the driving speed of the drive motor 40 based on the determination result by the determination device 120.

When the calculated value (H×V) obtained by multiplying the wrap height (H) by the driving speed (V) is less than approximately 500 mmHz, the determination device 120 and the command device 130 may determine that the driving speed of the drive motor 40 is lower than an optimum driving speed, and thus, output a command to increase the driving speed of the drive motor 40. On the other hand, when the calculated value (H×V) is more than approximately 1000 mmHz, the determination device 120 and the command device 130 may determine that the driving speed of the drive motor 40 is higher than an optimum driving speed, and thus, output a command to decrease the driving speed of the drive motor 40.

In a case that a scroll compressor having a preset wrap height is applied to a refrigerating cycle apparatus, the refrigerating cycle apparatus may change a driving speed of the drive motor according to a load change. In such a situation, the controller may calculate an optimum driving speed corresponding to a wrap height of the scroll compressor, thereby preventing the scroll compressor from being operated at a speed excessively lower or higher than an optimum driving speed. This may allow the scroll compressor to be operated at an optimum low speed corresponding to the wrap height, and thus, the compressor and a refrigerating cycle apparatus having the same may have enhanced performances.

In the embodiments disclosed herein, the scroll compressor is implemented as a low pressure type scroll compressor. However, the scroll compressor according to embodiments disclosed herein may be also applied to a high pressure type scroll compressor, where refrigerant is directly sucked into a compression chamber without passing through an inner space of a hermatic container, since a suction pipe directly communicates with a suction side of a compression device.

Embodiments disclosed herein provide a scroll compressor capable of having an enhanced performance by standardizing a wrap height of the scroll compressor which operates at a low speed less than ~35 Hz.

Further, embodiments disclosed herein provide a scroll compressor capable of controlling a drive motor so as to maintain an optimum drive speed according to a wrap height of the scroll compressor applied to a refrigerating cycle apparatus.

According to embodiments disclosed herein, a scroll compressor is provided in which wraps are formed such that a plurality of scrolls are engaged to one another, a compression chamber which is consecutively moved is formed as one of the plurality of scrolls performs an orbiting motion, and an orbiting speed of the scroll which is performing an orbiting motion is variable, the scroll compressor comprising: a control unit configured to control a value obtained by multiplying a wrap height (H) of the scroll by a driving speed (V) to be within a range of approximately 500~1000 mmHz when the scroll performs an orbiting motion with a speed less than approximately 35 Hz.

Further, according to embodiments disclosed herein, there is provided a scroll compressor, including a hermatic container, a drive motor installed at an inner space of the hermatic container, having a variable speed, and provided with a rotational shaft; a fixed scroll fixedly-coupled to an inner circumferential surface of the hermatic container at one side of the drive motor, and having a wrap of a predetermined height at one side surface thereof; an orbiting scroll having a wrap of a predetermined height at one side surface thereof so as to be engaged with the wrap of the fixed scroll, eccentrically coupled to a rotation shaft of the drive motor, and forming a compression chamber which is consecutively moved between the wraps while performing an orbiting motion with respect to the fixed scroll, and a sliding member configured to vary an orbiting radius of the orbiting scroll, wherein the fixed scroll and the orbiting scroll have a wrap height (H) optimum for a value obtained by multiplying the wrap height (H) by a driving speed (V) of the drive motor to be within a range of approximately 500~1000 mmHz when the driving speed of the drive motor is less than approximately 35 Hz.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a hermetic container;

a drive motor installed in an inner space of the hermetric container, the drive motor having a variable speed and being provided with a rotational shaft;

a fixed scroll fixedly-coupled to an inner circumferential surface of the hermetic container at one side of the drive motor, and having a wrap of a predetermined height at one side surface thereof;

an orbiting scroll having a wrap of a predetermined height at one side surface thereof, so as to be engaged with the wrap of the fixed scroll, eccentrically coupled to the rotational shaft of the drive motor, and forming a compression chamber which is consecutively moved between the wraps while performing an orbiting motion with respect to the fixed scroll; and a controller configured to control a value obtained by multiplying a wrap height (H) of the fixed scroll or the orbiting scroll by a driving speed (V) of the drive motor to be within a range of approximately 500~1000 mmHz when the orbiting scroll performs the orbiting motion at a speed less than approximately 35 Hz, wherein the controller comprises:

an input device configured to receive the driving speed (V) of the drive motor;

a determination device configured to check whether the calculated value (H×V) obtained by multiplying the driving speed (V) of the drive motor by the wrap height (H) is within the range, and determine whether the current driving speed is optimum; and a command device configured to control the driving speed of the drive motor based on the determination result by the determination device.

2. The scroll compressor of claim 1, wherein the wrap heights are within a range of approximately 20~40 mm.

3. The scroll compressor of claim 1, wherein the orbiting speed of the orbiting scroll is variable within a range of approximately 10~80 Hz.

4. The scroll compressor of claim 1, further comprising a sliding member configured to vary an orbiting radius of the orbiting scroll.

5. The scroll compressor of claim 4, wherein the sliding member is disposed between the orbiting scroll and a rotational shaft of the drive motor, and is slidably coupled to the orbiting scroll or the rotational shaft in a radial direction.

6. The scroll compressor of claim 5, wherein the sliding member comprises a driving pin attached to the rotational shaft, and wherein the sliding member is configured to be slidingly received in a sliding bush attached to the orbiting scroll.

7. The scroll compressor of claim 6, wherein the driving pin has a rectangular-circular shape.

8. An air conditioner comprising the scroll compressor of claim 1.

9. A scroll compressor comprising:

a hermetic container;

a drive motor installed in an inner space of the hermetic container, the drive motor having a variable speed and being provided with a rotational shaft;

a fixed scroll fixedly-coupled to an inner circumferential surface of the hermetic container at one side of the drive motor, and having a wrap of a predetermined height at one side surface thereof;

an orbiting scroll having a wrap of a predetermined height at one side surface thereof, so as to be engaged with the wrap of the fixed scroll, eccentrically coupled to the rotational shaft of the drive motor, and forming a compression chamber which is consecutively moved between the wraps while performing an orbiting motion with respect to the fixed scroll;

a controller configured to control a value obtained by multiplying a wrap height (H) of the fixed scroll or the orbiting scroll by a driving speed (V) of the drive motor to be within a range of approximately 500~1000 mmHz when the orbiting scroll performs the orbiting motion at a speed less than approximately 35 Hz; and a sliding member configured to vary an orbiting radius of the orbiting scroll, wherein the sliding member is disposed between the orbiting scroll and the rotational shaft, and is slidably coupled to at least one of the orbiting scroll or the rotational shaft in a radial direction, wherein the sliding member comprises a driving pin attached to the rotational shaft, and wherein the sliding member is configured to be slidingly received in a sliding bush attached to the orbiting scroll.

10. The scroll compressor of claim 9, wherein the driving pin has a rectangular-circular shape.

11. The scroll compression of claim 9, wherein the wrap height is within a range of approximately 20~40 mm.

12. The scroll compressor claim 9, wherein the driving speed of the drive motor is variable within a range of approximately 10~80 Hz.

13. The scroll compressor of claim 9, wherein the inner space of the hermetic container is divided into a suction space and a discharge space, a suction pipe is connected to the suction space, and a discharge pipe is connected to the discharge space.

14. The scroll compressor of claim 9, wherein a suction pipe is directly connected to the compression chamber formed by the fixed scroll and the orbiting scroll, and a discharge pipe is connected to the inner space of the hermetic container.

15. An air conditioner comprising the scroll compressor of claim 9.

* * * * *